US005622130A

United States Patent [19]

Calderon et al.

[11] Patent Number: 5,622,130

[45] Date of Patent: Apr. 22, 1997

[54] HEEL CONTROL SYSTEM FOR SAILING YACHTS AND SAILING YACHT HULL

[75] Inventors: Alberto A. Calderon, La Jolla, Calif.; Charles W. Robinson, Santa Fe, N.M.; William F. Burns, III; Matthew B. Brown, both of San Diego, Calif.

[73] Assignee: Dyna-Yacht, Inc., San Diego, Calif.

[21] Appl. No.: 446,455

[22] Filed: May 22, 1995

[51] Int. Cl.[6] ..... B63B 35/00

[52] U.S. Cl. ..... 114/39.1; 114/124; 114/140

[58] Field of Search ..... 114/336, 322, 114/323, 324, 325, 36, 39.1, 271, 283–285, 56, 61, 343, 348, 349, 68, 360, 65 R, 66, 102, 124, 127, 128, 132, 135, 136, 140, 143, 173, 176, 177, 201 R, 203; D12/303, 304

[56] References Cited

U.S. PATENT DOCUMENTS

| | | | |
|---|---|---|---|
| 1,377,222 | 5/1921 | Russell | 114/68 |
| 1,697,020 | 1/1929 | Priebe et al. | 114/336 |
| 2,858,788 | 11/1958 | Lyman | 114/39.1 |
| 3,140,686 | 7/1964 | Olivotti | 114/56 |
| 3,903,827 | 9/1975 | Marcil | 114/143 |
| 4,453,484 | 6/1984 | Englund | 114/143 |
| 5,152,239 | 10/1992 | Hossfield et al. | 114/144 E |
| 5,163,377 | 11/1992 | Calderon et al. | 114/143 |
| 5,433,162 | 7/1995 | Shigematsu et al. | 114/124 |

FOREIGN PATENT DOCUMENTS

| | | | |
|---|---|---|---|
| 2618407 | 1/1989 | France | 114/102 |
| 63-130492 | 6/1988 | Japan | 114/61 |
| 331 | 1/1896 | United Kingdom | 114/61 |
| WO94/18063 | 8/1994 | WIPO | 114/56 |

*Primary Examiner*—Edwin L. Swinehart
*Attorney, Agent, or Firm*—Robert B. Block

[57] ABSTRACT

High performance sailing yacht designs are disclosed based on a keelless sailing yacht concept having dynamic gravitational ballast which is laterally movable for heeling resistance which ballast replaces a function of the standard keel. A keelless yacht of this type is disclosed with an adjustable flap mounted on an elongated strut from which the ballast is suspended below the hull to generate a variable heel hydrodynamic control force independently of the counter-heeling effect achieved by the ballast. The foregoing features enhance the effects of disclosed improvements and modifications to hull design in having a duplex form, with upper and lower hull shapes, the lower of low drag shape, and of reduced section, while the upper hull extends laterally abeam from the lower hull to define reserve buoyancy, added accomodation, and surfaces adapted for hydroplaning when the yacht is at a controlled angle of heel.

27 Claims, 9 Drawing Sheets

HEEL CONTROL SYSTEM FOR SAILING YACHTS AND SAILING YACHT HULL

FIELD OF THE INVENTION

The present invention relates generally to sailing yachts and to a high performance keelless sailing yacht with an improved design for controlling heeling thereof. The invention relates more particularly to a heel control system which is operable in conjunction with, yet independently from, the operation of a dynamic counter-heeling solid ballast for achieving a) significant increase of righting moment of hydrodynamic origin as boat speed increases and b) a high degree of control of the angle of heel (both positive and negative to provide heel and counter heel). The foregoing control leads to and enhances disclosed improvements and modifications to a sailing hull design.

BACKGROUND OF THE INVENTION

In the conventional keeled hull, as was formerly known, heeling was controlled by a ballasted keel which extended fore and aft of the hull and below the same along the centerline or midplane. The keel was normally laterally fixed in position at the midplane so that the angle of heel could be changed only by lateral motion of ballast (sandbags) or lateral motion of crew weight. The keelless hull concept evolved to overcome the above limitations and disadvantages of previous yacht designs.

In the keelless hull shown in U.S. Pat. No. 5,163,377, issued Nov. 17, 1992 to Calderon et al. and entitled SAILING YACHT, a dynamic, laterally swingable or canting ballast is suspended generally beneath the hull to provide a counter heeling force when the yacht is underway. While providing significant improvements over fixed keel designs in respect to heeling resistance and roll stability, it has been observed that in some conditions it would be desirable to augment the counter heeling effect achieved with dynamic ballast. For instance, when the ballast is positioned at a limit position thereof and fluctuations in operating conditions are experienced, such as when an increase in true wind velocity above high true wind average is experienced, additional counter heeling force is not available from the dynamic ballast and the vessel may assume an undesired angle of heel.

Another instance is when the designer chooses to decrease lead weight of ballast to enhance downwind performance, in which case canting a higher weight is not possible, even though additional righting movements are desirable.

The magnitude of control force normally required to position the ballast can limit responsiveness of the strut and impact the yacht's ability to compensate for turbulent operating conditions, such as choppy water or shifting winds. Further, the ballast weight necessary to achieve an appropriate righting moment in all circumstances can contribute adversely to the vessel's overall weight and consequently effect the vessel's ability to achieve and maintain a hydroplaning condition of the hull. The need exists for an improved design wherein all of the above factors are considered and addressed.

SUMMARY OF THE INVENTION AND OBJECTS

It is a general object of the present invention to provide a heel control system for sailing yachts and a sailing yacht hull which will overcome the above disadvantages and limitations.

It is a further object of the present invention to provide a sailing yacht of the above character where (a) the gravitational function of heeling resistance is supplied by a dynamic, laterally shiftable ballast, and (b) the function of heel control is achieved hydrodynamically with a movable control surface associated with, yet independently operable from, the operation of the ballast.

It is a further object of the present invention to provide a sailing yacht of the above character having a dynamic ballast mounted to a laterally swingable strut for adjustment to extreme angles to provide gravitational counter-heeling force and an adjustable flap connected along a leading edge thereof to a trailing edge of the strut for inducing hydrodynamic force on the strut and augmenting heel stability about heel angles established by the position of the ballast.

It is a further object of the present invention to provide a sailing yacht of the above character having (a) an elongated strut mounted to support a ballast and to rotate about a first axis lying fore and aft on or contiguous to the vessel centerplane at about midships and (b) an adjustable flap mounted to rotate about a second axis in response to operation of first and second drive means which are operationally independent of each other.

It is a further object of the present invention to provide a sailing yacht of the above character having an active control using a mechanical, gyroscopic, or inertial heel position sensor for outputs applied to controllers for rotating the heel control flap.

It is a further object of the present invention to provide a sailing yacht of the above character in which the new concept of heel control with an adjustable flap on a counter heeling dynamic ballast in such a manner that overturning moments are countered more effectively allows a redesign of the hull with reduced surface area and drag; improved broaching resistance for safety and modified pitching characteristics for crew comfort; and decoupling of natural dynamic characteristics of the vessel from the dynamic behavior of a body of water in which the vessel is operated.

It is a further object of the present invention to provide a sailing yacht of the above character in which the use of a heel control flap reduces the amount of mass required in a dynamic ballast so that the overall vessel weight to sail area ratio becomes well suited to hydroplaning of the hull and improved downwind performance.

It is a further object of the present invention to provide a sailing yacht of the above character in which the improvement in heeling force control allows the use of semi circular hull forms (in section) below the water line for reduced drag and increased speed.

It is a further object of the present invention to provide a sailing yacht utilizing an improved hull design having a duplex form, with upper and lower hull shapes, the lower of low drag shape, and of reduced section, while the upper hull defines surfaces adapted for hydroplaning when the yacht is at a controlled angle of heel and which is also an improvement over the duplex hull shown in the referenced U.S. Pat. No. 5,163,377.

It is a further object of the present invention to provide a sailing yacht of the above character in which the upper and lower hull sections are merged adjacent or at a waterline of said yacht and define a pair of downwardly opening channels which extend longitudinally of the hull between the lower hull portion and the planing surfaces for directing waves generated at the bow or stern of the hull to apply a lift force for lowering the waterline and reducing drag on the hull.

It is a further object of the present invention to provide a sailing yacht of the above character in which the upper hull extends laterally abeam from the lower hull for added buoyancy when heeled and for accommodation room, and drag is reduced.

It is a further object of the present invention to provide a sailing yacht of the above character in which the upper hull extends laterally abeam from the lower hull at locations spaced inwardly from the bow and stern (that is, confined generally centrally of the hull centerline near midsection) to define "wings" whereby the impact of sea waves encountered by the forward portion of the lower hull is substantially dissipated forward of the wings and the pitching moment experienced at the upper hull is thereby reduced to enhance comfort of occupants.

The present invention offers improvements and performance advantages over what has heretofore been disclosed as a concept for a keelless hull in a sailing yacht. That is, it has been established a priori that the combined functions of leeway control and heeling resistance normally assigned to the keel of a sailing yacht can be better effected without a conventional keel. Instead, a laterally swingable ballast is provided and carried on a strut to provide gravitational counter heel force, and the portion of the strut which is adjustable to provide the desired hydrodynamic counter-heeling force. The separate hydrodynamic side force function (leeway control) has been effected, for example, with fore and aft underwater sailing foils which are independently, and or in coordination (cyclic and collective), rotatable to provide controllable and adjustable leeway.

The ballast in a keelless hull can be a heavy streamlined appendage mounted at a good depth separate from and under the mid-body of the hull by means of the strut which is swingable to port or starboard from a bearing in the hull to adjust the lateral position of the ballast and the amount of counter-heeling force of gravitational action on lead. The present invention provides a keelless hull in which the gravitational ballast function (counter-heeling force) associated with a shiftable solid ballast is significantly augmented and more precisely controlled by a new and separate hydrodynamic appendage.

More particularly, an adjustable heel control flap is connected to the trailing edge of the strut and is rotatable about a hinge axis to induce a hydrodynamic force on the strut which force in turn is transferred to the hull. A linkage system turns the flap about its hinge axis for operation independently of operation of the swingable strut and for providing fine heeling control with minimum energy consumption.

The increase in sailing efficiency brought about by the deployment of an adjustable heel control flap in the manner described in the present invention is manifest in a plethora of performance advantages.

For instance, when the yacht is operating at a condition in which the swingable ballast is positioned at a maximum (limit) angle of the strut relative to the hull and an increase in true wind velocity is experienced, such as when the true wind velocity increases from 16 knots to 20 knots and increases the tendency to heel, the angle of heel can be maintained by actuation of the flap, said actuation inducing a hydrodynamic down force on the strut for increasing the righting moment on the yacht and compensating for the change in wind velocity.

Another advance made possible with the present invention are the numerous benefits attained from a dynamic control. When equipped with a heel sensor and appropriate controls for operation of the heel control flap, the flap forms the basis of an active control system for countering the heeling effects of turbulent water conditions on a per wave basis. Moreover, such an active control provides means for oscillating the heel control flap about a neutral position defined by the cant angle of the strut. However, the safe utilization of the flap control should include safety features which must prevent the flap from being deflected in a direction which increased heel angle, whether by human error or mechanical malfunction.

An additional advantage of such an active control includes the capability of decoupling the natural roll period of the yacht (as dictated by the inertial characteristics and distribution of the overall yacht mass about the roll axis) from the period of prevailing waves for enhancing occupant comfort when, for example, (a) the yacht is anchored in an open bay and the natural roll frequency of the yacht is harmonically excited by prevailing wave conditions, (b) when the yacht is sailing downwind, and (c) when sailing in other points of sail.

Operation of the heel control flap still further advances the state of the sailing art by providing (a) hydrodynamic means for aiding canting of the strut and therefor initiating and sustaining movement of the ballast, particularly at high cant angles.

Yet another more advantage of the flap when the strut is canted at a large angle is the flap ability to redirect surrounding water upwards towards the surface when generating an increase of counter heel. This upward water deflection fills in the trough generated by the hull mid-body in a canceling manner which decreases the wave making drag of the hull, increasing boat speed.

Yet another advantage of the flap is its capability to increase righting moments as speed of boat increases with increasing true wind velocity.

Enhanced control is yet another of the many advantages provided by the present invention. Rapid reaction of the heel control flap to sudden increases in wind speed, such as, say, rotation from 10 degrees to 15 degrees, increases drag immediately and thus slows the yacht. In addition, increased drag force creates a yawing moment which tends to head the yacht into the wind, thereby unloading the sails and reducing the external heeling moment, reducing broaching moments.

There are two basic features of the adjustable flap: the aforementioned benefits of increased heel control, and a reduction in the mass of a ballast which is required to generate counter-heeling force. That is, the ballast weight (and thus overall yacht weight) can be reduced since supplemental counter-heeling force is attainable by operating the heel control flap, thereby increasing the apparent weight and providing adequate heeling resistance. Decreased weight is important, as discussed hereinbelow, for achieving (a) improved downwind performance when righting moments are not needed, and (b) a hydroplaning condition of the hull wherein a minimized ratio of vessel weight to sail area is highly desirous. However, the flap control does not replace the need for lead ballast as a primary source of stability, in which the reliability of the canting system must be established by adequate design features, including fail safe criteria.

A light weight to sail area ratio introduces the concept of a bi-modal or duplex hull which has a slender buoyancy center body of semi-circular section and an upper, laterally extended hull for hydroplaning on the bow and stern waves when the yacht is heeled. As noted, the fine control and reduced weight made possible with the heel control flap of the present invention facilitates the hydroplaning condition and provides the attendant advantages in drag reduction and improvement in downwind running speed.

An additional factor included in the concept of the present invention is the concentration of the upper hull abeam extensions at substantially only midsection for defining internal occupant compartments abeam of the lower hull. A principal advantage of the noted construction is that the narrow canoe of the lower hull breaks the sea waves so that by the time the sea waves reach the upper hull section, occupants of the compartments experience only heel and the pitching moment about the compartments is reduced.

Further, the outboard compartments in a canting ballast, twin foil boat define inherent reserve buoyancy in the yacht such that in the event of a failure of the canting ballast system, the yacht will go to heel until the upper hull engages the water surface, at which point a reserve righting moment is provided independent of the hydrodynamic heel control flap and the gravitational dynamic ballast.

In summary, these features, the augmentation of counter-heeling force with an adjustable flap for highly controlled heeling, the construction of the hull into two sections, the lower section for fast sailing and upper section for hydroplaning when controllably heeled, combined with maximum safety and buoyancy when lowered, provide a sailing yacht that can be adjusted to prevailing conditions to achieve maximally effective performance under a wide range of conditions.

These and other features and objects of the invention will become apparent from the following detailed description when taken in conjunction with the accompanying drawings and claims, of which:

The following definitions are used herein to describe the hull geometry:

A centerline is a line lying in the vertical longitudinal plane cutting the hull down the middle from bow to stern.

Waterlines (or level lines) are defined as the intersection with the hull of waterplanes perpendicular to the hull centerplane, at various elevations.

Sections are defined as the intersection of a series of spaced vertical planes cutting the hull transversely to a centerline.

A midsection is one of the sections lying generally in the middle of the hull.

DETAILED DESCRIPTION OF THE PREFERRED EMBODIMENTS

Referring now to FIGS. 1 to 4, the sailing yacht of the present invention is shown in detail with particular reference to the function of the adjustable heel control flap.

Figure 2:
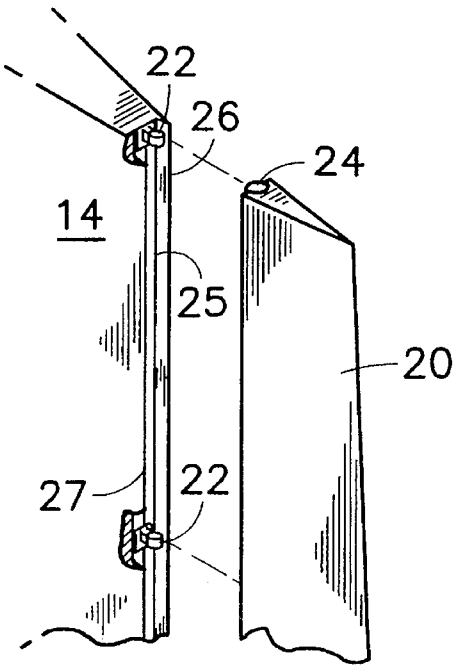
FIG. 2 is an exploded view partially broken away of the canting ballast strut support and the heel control flap of the yacht of FIG. 1.
Figure 1:
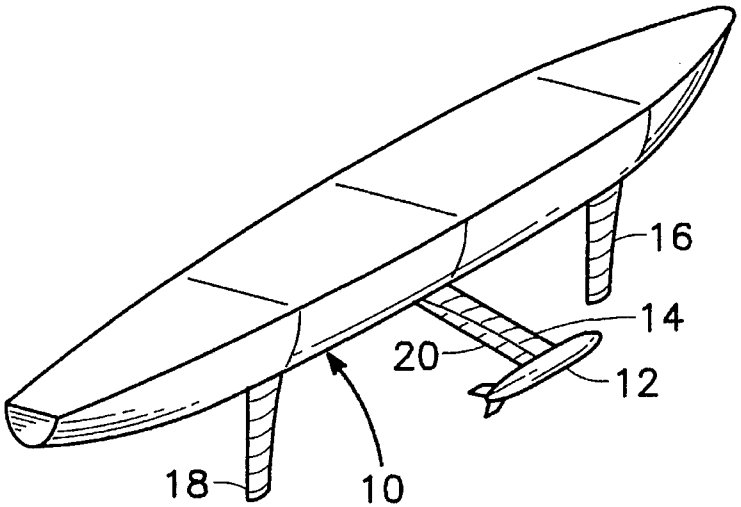
FIG. 1 is a perspective view of a heel control system for a sailing yacht with a heel control flap constructed in accordance with the present invention.

FIG. 1 shows a typical hull 10 with ballast 12. The ballast is carried at the lower end of a strut 14 which is mounted and supported contiguous the lowermost portion of the hull 10. When canted as shown, it provides a gravitational force $F_G$ which generates a righting moment to oppose heeling moment of the wind on the sails. Fore and aft hydrofoils, hereinafter foils, 16, 18 are mounted to depend vertically from the hull on midplane and are positioned forward and rearward from the strut 14. Foils 16 and 18 can be collectively or oppositely rotated by suitable controls to achieve steering or leeway control of the yacht, as desired. Exemplary controls for operating foils 16 and 18 are disclosed in Calderon et al U.S. Pat. No. 5,163,277, issued Nov. 17, 1992, the entirety of which is incorporated herein by reference.

An adjustable flap 20 is hinged to the trailing edge of the strut 14 which generates, together with the strut a hydrodynamic force $F_H$ which in FIG. 1 aids the righting moment contributed by the lead. The flap is mounted on the strut by inserting a hinge rod through hinge blocks 22 on the strut 14 and aligned openings 24 on the flap 20. The flap 20 and strut 14 are merged together to form a hydrodynamically smoothly shaped foil with the leading edge of the flap being inserted into a rearward facing recess 25 in the aft of the strut 14 alongside of which are rearwardly extending skirts or lips 26, 27 for smoothly covering the transition between them. Mass distribution at the leading edge of the flap 20 can be supplemented with additional weight to resist hydrodynamic flutter of the flap 20 during operation of the yacht.

Figure 3:
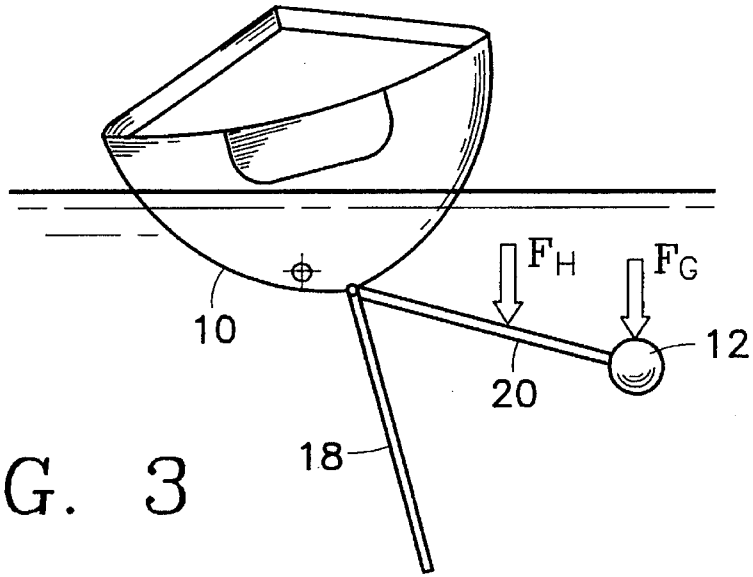
FIG. 3 is a perspective view into the stern of the sailing yacht of FIG. 1 as it would appear while sailing on starboard tack with an approximately 15 degree angle of heel.
Figure 4:
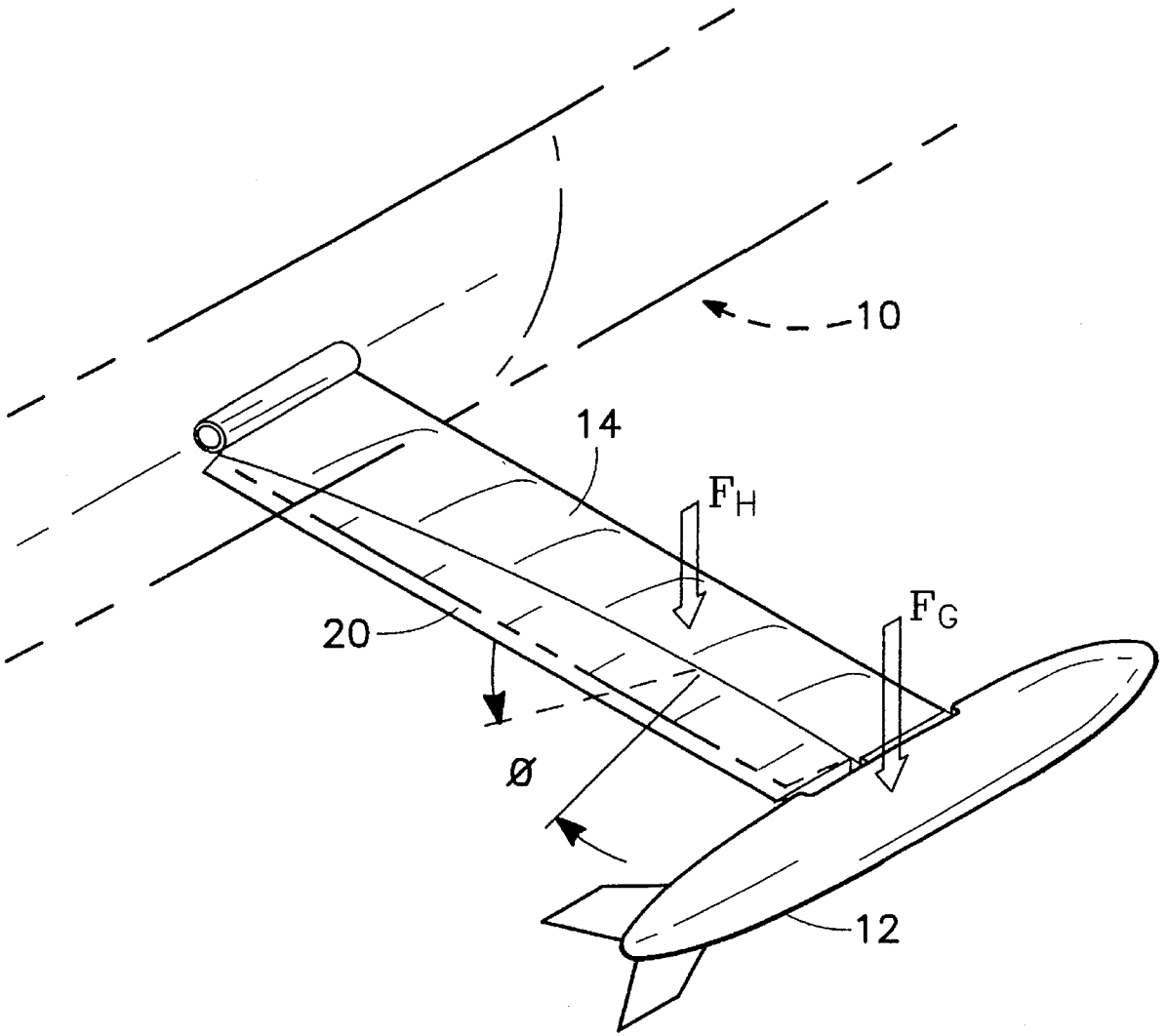
FIG. 4 is an enlarged perspective view of the heel control flap, strut and ballast structure of the sailing yacht of FIG. 1.

While the ballast is shown depending straight downward amidships and the flap is not actuated in FIG. 1, the ballast is shown moved approximately 60 degrees to starboard and the flap is shown actuated through an angle of approximately 10 degrees in FIGS. 3 and 4 for generating a forces $F_G$ and $F_H$ so as to give righting moment to the hull 10 which is illustrated as it would appear on starboard tack.

Figure 5:
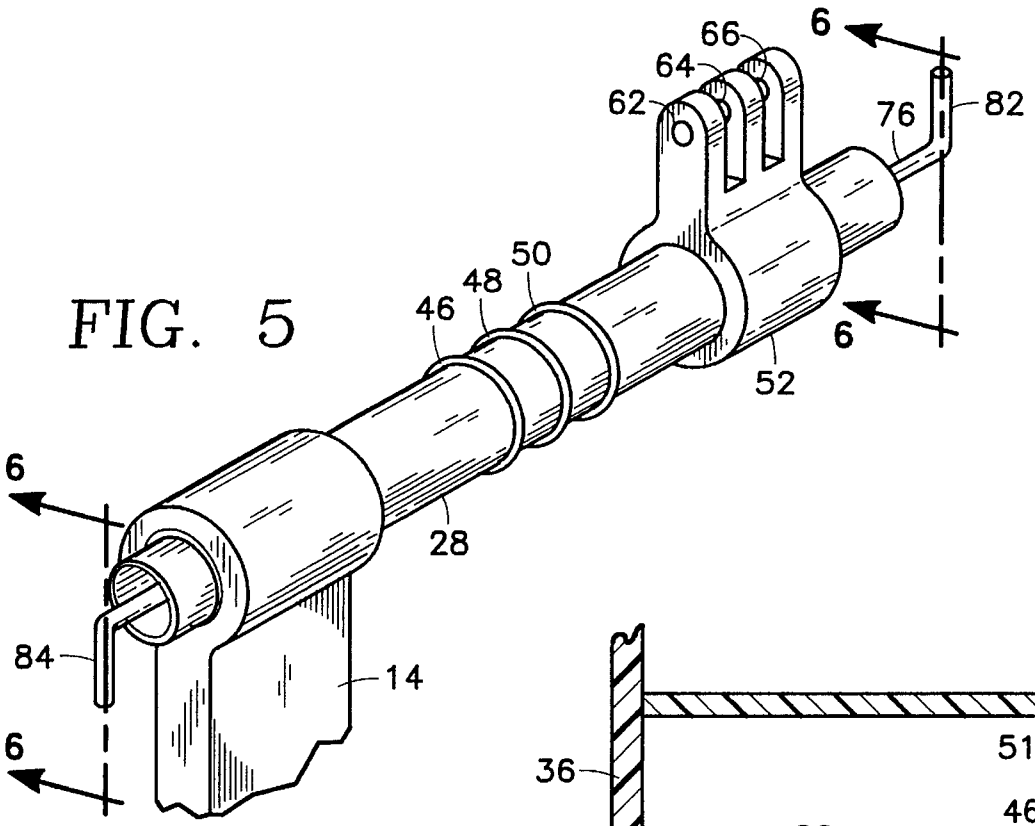
FIG. 5 is an enlarged perspective view showing the mounting structure and drive mechanism for the strut and the heel control flap.
Figure 6:
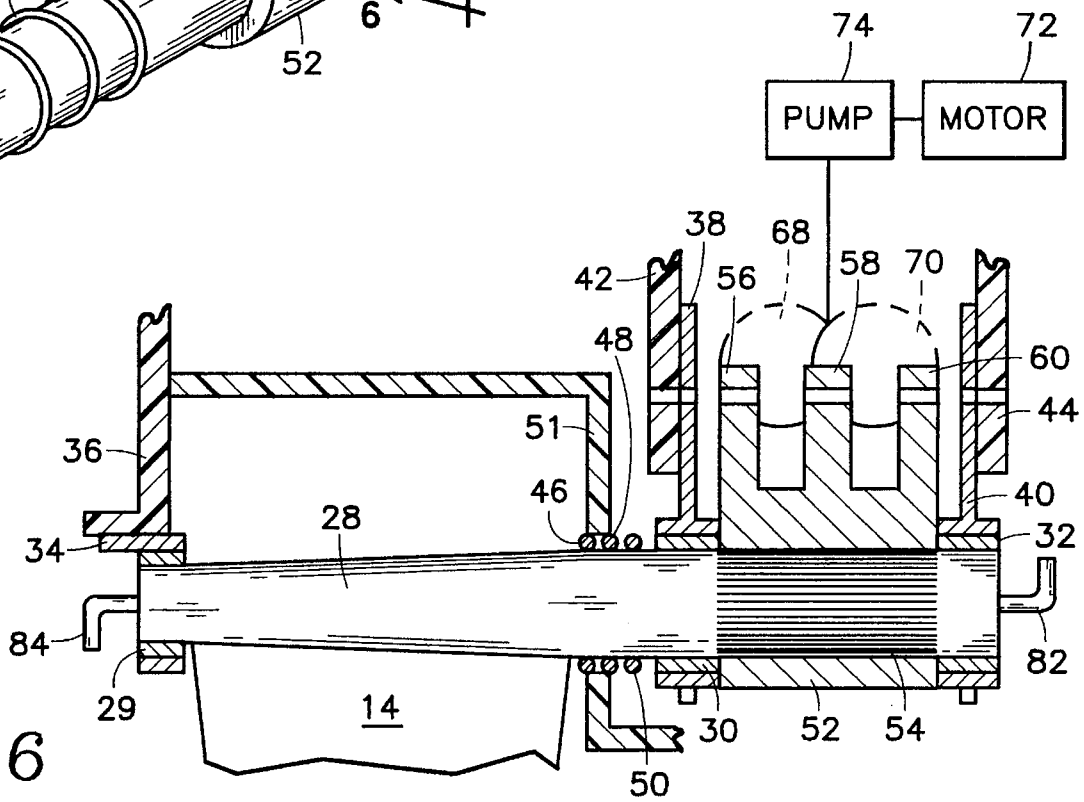
FIG. 6 is a vertical cross sectional view taken through a structure similar to but more compact than that of FIG. 5.
Figure 7:
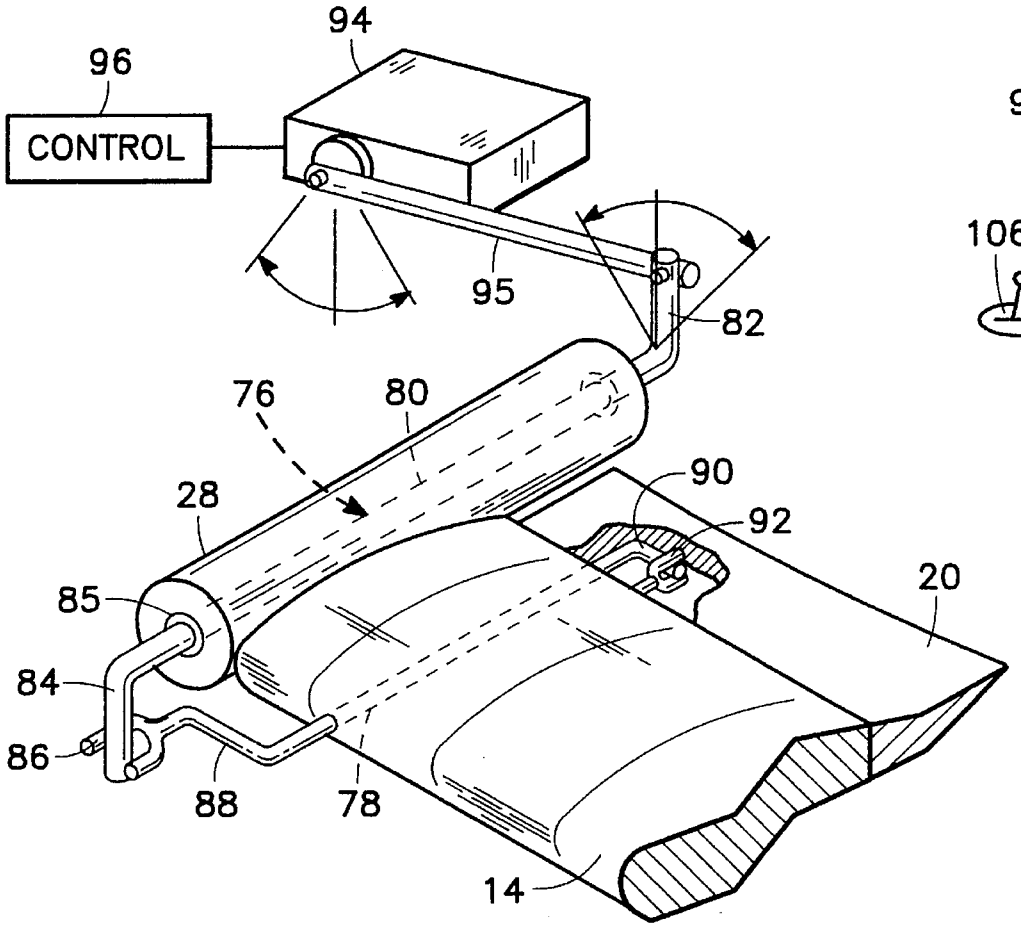
FIG. 7 is a schematic diagram showing the heel control actuators for varying the angle of rotation of the heel control flap of FIGS. 1–6.

FIGS. 5 to 7 shows the mounting and drive arrangements for swinging the strut 14 to shift the ballast 16 as well as for rotating the flap 20 independently of movement of the strut 14. The strut 14 has an integral hollow drive shaft 28 supported for rotation about an axis lying fore and aft on the hull centerline by bearings 29, 30, 32. Aft drive shaft bearing 29 is fixed to a bearing block 34 which is secured to the underside of hull 10 adjacent a bulkhead 36. Forward drive shaft bearings 30 and 32 are mounted on axially spaced brackets 38 and 40, respectively, which brackets are secured to adjacent bulkheads 42 and 44, respectively. Bulkheads 36, 42 and 44 are typically of composite construction with sufficient rigidity and strength to effectively transfer and distribute strut reaction force to the hull 10. Seals 46, 48 and 50 are positioned as illustrated for resisting leakage into the bilge. Seal 50 serves as a reserve seal which can be readily positioned adjacent the inboard face of hull section 51 in the event of a failure of the seal 48.

A control arm 52 is splined to the forward end 54 of the drive shaft 28 and is captured between the bearings 30 and 32. The control arm 52 has a series of generally radial fingers 56, 58 and 60 with axially aligned openings 62, 64, 66 therein for pivoting connection with the end of one of a pair independently actuatable hydraulic cylinders 68 and 70 (shown in phantom line in FIG. 6). Alternate synchronous extension and retraction of hydraulic cylinders 68 and 70 causes rotation of the control arm 52, the drive shaft 28, and the strut 14 for shifting the ballast 12 to port or to starboard from the generally midposition shown in FIG. 1. Actuation of the hydraulic cylinders is achieved in a manner believed generally known, such as, for example, by cooperation of an electric motor 72 and a hydraulic pump 74, the motor driving the pump for supplying fluid under pressure to pistons (linear actuators) in the corresponding hydraulic cylinders 68 and 70.

Referring also to FIG. 7, a linkage for mounting and rotating the flap 20 includes an input shaft 76 and an output shaft 78. The input shaft 76 has an elongated center section 80 which extends generally coaxially through the drive shaft 28 between an inboard shaft end 82 and an outboard shaft end 84. Each of the shaft ends 82, 84 is bent approximately 90 degrees relative to the center section 80. A seal 85 surrounds outboard shaft end 84 and resists leakage into the drive shaft. The output shaft 78 is mounted in a generally fore and aft opening in the strut 14 and has a Y-shaped yoke 86 positioned on a yoke arm 88 for driving engagement with the outboard end 84 of the input shaft 76. An opposite end 90 of the output shaft is bent approximately 90 degrees relative to the shaft 78 and is received in a follower 92 mounted in the flap 20.

The inboard end 82 of the input shaft 76 preferably is coupled with a suitable drive means, such as an electric motor 94 and a linear actuator 95, for applying force to the inboard shaft end 82 and for rotating the input shaft 76 about the longitudinal axis of center section 80. Cooperation between the outboard shaft end 84 and the yoke 86 in turn causes rotation of the output shaft 78, so that interaction of the output shaft end 90 and the follower 92 results in rotation of the flap 20 about the hinge axis alternately from a generally neutral position to opposed limit positions thereof and for securing the flap at any position therebetween while the yacht is underway. The structures shown in FIGS. 5 to 7 are only by way of illustrations of, but is of sufficient sophistication that extensive strut analysis, ground tests, and systems tests to be carried out to assure it safety in use.

Figure 8:
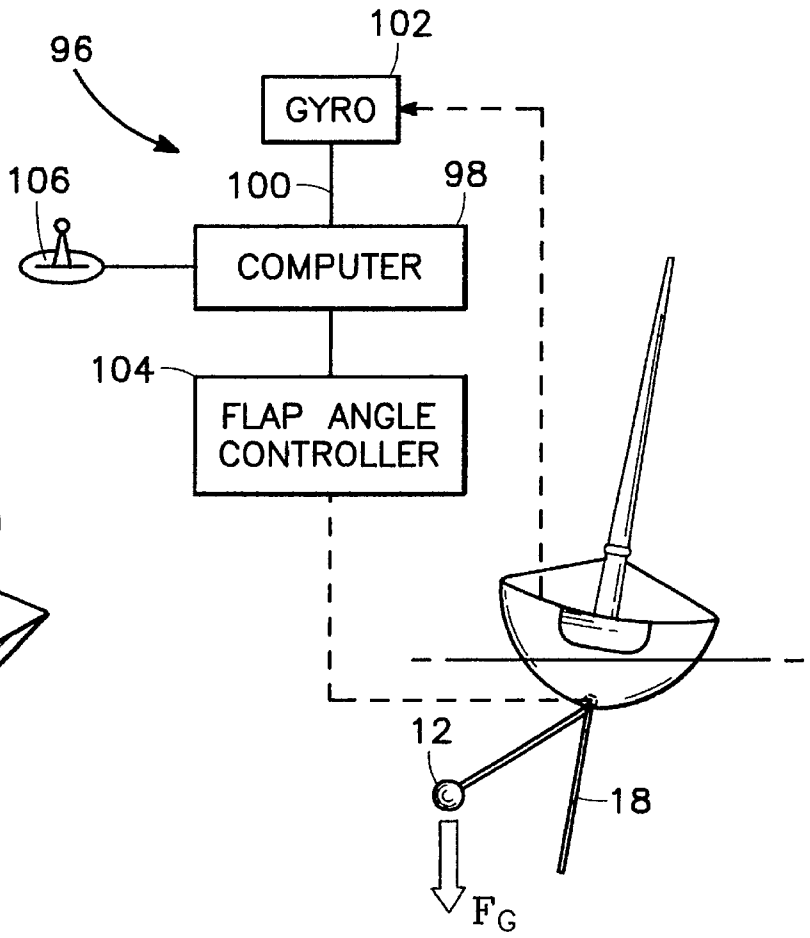
FIG. 8 is a schematic diagram showing the heel control circuit sensors for operating the actuators of FIG. 7.

Control means, generally designated at 96 in FIG. 7 and shown somewhat schematically in the sketch of FIG. 8, are provided for operating the heel control flap 20. Having established the angle of heel desired for certain wind strength, relative wind direction, and wave considerations, which may from test data, the results become records plotting flap angle as functions of wind speed and apparent direction. These may be readily programmed into a computer 98 which receives the output 100 of a heel indicator such as gyro 102 or an inertial sensor (i.e., a pendulum) mounted on board. The difference of deviation output 100 from comparing the actual angle of heel with the stored program is applied to a controller circuit 104 for signaling the motor 94 to move the flap 20 to a flap position which decreases the difference as much as desired.

In one exemplary embodiment of the control means 96, the heel indicator comprises an on board damped pendulum coupled with a square wave generator so that the amplitude of the pulse output from the generator is directly proportional to the amplitude of oscillation of the pendulum. The pulse output is supplied to the motor 94 for actively controlling the flap angle as a function of the angle of heel of the yacht on a per wave basis.

The above control features are described as automated, but may be manually overridden or put under a manual control through a separate computer input, as from a single, two-dimensional joystick 106 control input to the computer.

Figure 9:
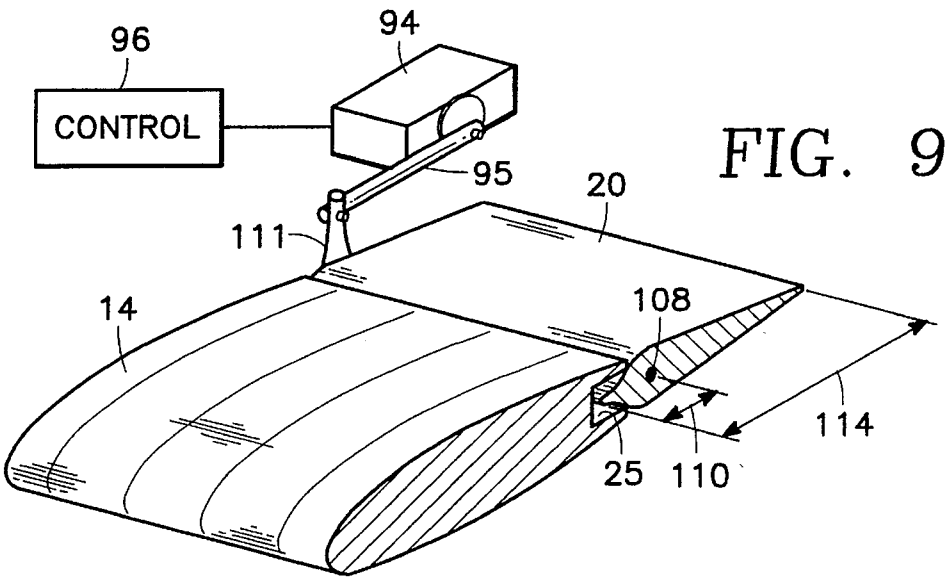
FIG. 9 is a somewhat schematic view showing a first alternative drive mechanism for rotating the heel control flap of FIGS. 1–6.
Figure 10:
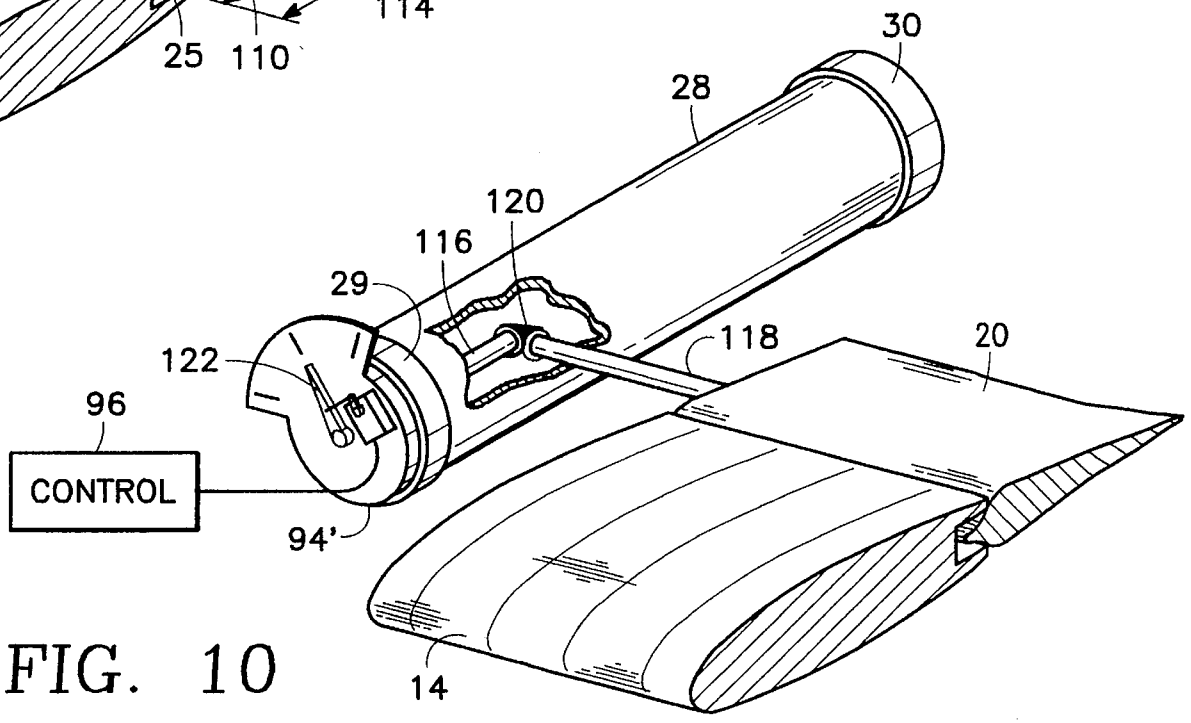
FIG. 10 is an enlarged perspective view partially broken out showing a second alternative drive mechanism for rotating the heel control flap of FIGS. 1–6.

Alternative arrangements for mounting and rotating the flap 20 are illustrated in FIGS. 9 and 10. In the embodiment shown in FIG. 9, the flap 20 is rotatable on a vertical shaft 108 located a distance 110 from the leading edge. An arm 111 is pivotally interconnected between the upper end of the shaft 108 and the linear actuator 95 to effect rotation of the flap 20 when the motor 94 is operated by the control 96. Distance 110 is approximately 20%–25% of the flap chord 114 to provide large side forces with low control forces and energy consumption. In the embodiment shown in FIG. 10, rotation of the heel control flap 20 is effected by cooperation of a pair of orthogonal drive shafts 116 and 118 coupled by a bevel gear set 120. Shaft 118 extends generally vertically through the flap 20 and engages the shaft 116 which extends generally coaxially through the strut drive shaft 28. A motor 94' is mounted on the end of the drive shaft for rotating the shaft 116 and receives command input for the aforementioned control means 96. A flap angle indicating dial gauge 122 is provided on motor 94' for providing a visual indication of the angle of flap 20 relative to the strut 14.

As has been mentioned earlier, it is a safety requirement that the flap does not increase heel of the boat. Accordingly, the sensors, servos, control mechanisms and other devices and functions of FIGS. 7 to 10 should have aerospace standards comparable to active control surfaces in aircraft, and the features of FIGS. 7 to 10 should be designed to and tested by an aerospace standards capable of guaranteeing the safety and reliability of the systems.

Figure 11:
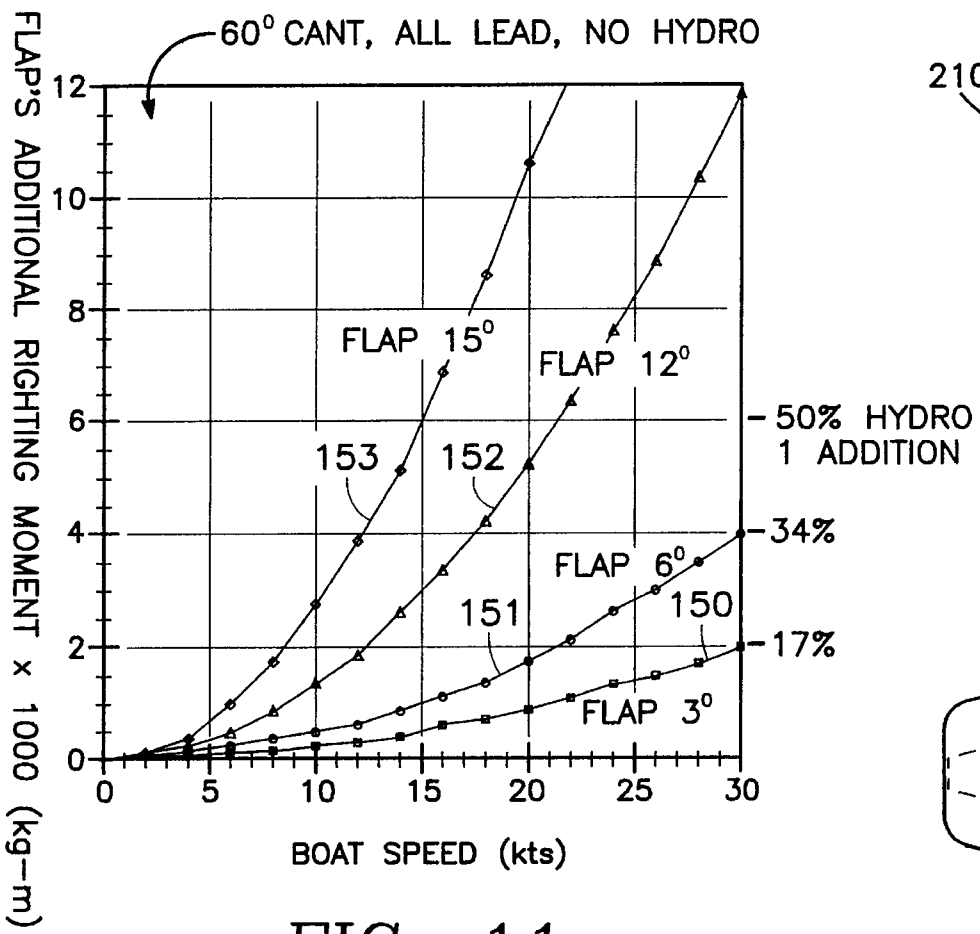
FIG. 11 are graphs of the righting moment of the yacht of FIGS. 1–10 as a function of flap angle and boat speed.

FIG. 11 shows graphs for the righting moment and forces of a yacht constructed in accordance with the present invention compared to a keelless yacht without a heel control flap (that is, as compared to a yacht having only cantable ballast for counter heeling). Curves 150–153 show the righting moment contribution of the heel control flap 20 as a function of boat speed at a plurality of flap angles with a cant (strut) angle of 60 degrees and 10 degrees heel. Curve 150 represents flap righting moment characteristics at a heel control flap angle of 1 degree; curve 151 represents flap righting moment characteristics at a heel control flap angle of 2 degrees; curve 152 represents flap righting moment characteristics at a heel control flap angle of 6 degrees; curve 153 represents flap righting moment characteristics at a heel control flap angle of 12 degrees. As indicated by the incremental distance indicated at 156, the yacht of the present invention at 10 knots is capable of generating greater than 2500 kg-m more uprighting moment than a keelless heel without a heel control flap.

Operating advantages of the heel control flap 20 can be understood, for example by considering a yacht operating at a condition in which the swingable ballast 12 is positioned at a maximum (limit) angle of the strut 14 relative to the hull and an increase in true wind velocity is experienced, such as when the true wind velocity increases from 10 knots to 15 knots. Although the ballast cannot be shifted any further to compensate for the change in broaching moment, the angle of heel can be maintained by actuation of the flap 20 for inducing a hydrodynamic down force F on the strut and increasing the righting moment on the yacht.

The active control mode of the control means 96 also introduces a number of advances in yacht performance and safety. For example, when relying on inertial heel sensor 102 in a closed servo-control loop, the heel control flap 20 forms the basis of an active control system for countering the heeling effects of turbulent water conditions on a per wave basis. Moreover, such an active control provides means for oscillating the heel control flap about a neutral position defined by the cant of the strut 14, provided the aerospace safety criteria specified before is fully satisfied.

For example, it is evident for FIG. 11 that if there is an unintended use or accidental situation on the flap control system which develops force which tends to heel the boat in the same direction as the heel due to wind or waves, the boat can roll over. Hence, aerospace level design, which is beyond the scope of this specification is needed at its source level as active controls for aircraft, including fail safe, redundancy, static tests of various types, fatigue tests and extensive sailing tests, as is done for aircraft.

An additional advantage of such an active control includes the capability of decoupling the natural roll period of the yacht (as dictated by the inertial characteristics and distribution of the overall yacht mass about the roll axis) from the period of prevailing waves for enhancing occupant comfort when, for example, the yacht is anchored in an open bay and the natural roll frequency of the yacht is harmonically excited by prevailing water conditions.

Operation of the heel control flap still further advances the state of the sailing art by providing means for aiding actuation of the strut and for initiating and sustaining movement of the ballast, particularly at high cant angles where the ballast is subjected to extreme hydrodynamic effects near the water surface.

Inherent safety benefits are still further advantages provided by the present invention. Rapid reaction of the heel control flap 14 (such as in an active control mode) to sudden increases in wind speed increases drag immediately and thus slows the yacht. In addition, increased drag force creates a yawing moment which tends to head the yacht into the wind, thereby unloading the sails and reducing the external broaching moment.

It follows from all of the remarks above, that the powerful effects which the flap can introduce to a yacht require control sophistication and reliability, which is available not only from aerospace technology, but also in advanced automotive technology. As examples applied to yachts, the proper operation of canting angle of strut, boat heel, and flap angle can be monitored by sensors capable of diagnosing any failure of the system. If a faulty connection disables a hydraulic or electric component of the system, the sensors will detect the problem and signal a computer to connect the system elsewhere, such as to a backup unit, all while the yacht is under sail, thus preventing a breakdown. Also, some of these sensors will record wear of parts, alerting to potential trouble. Self diagnosis thus adds to reliability. Moreover, a yacht stability management system can coordinate various sensors that detect kinematics of yacht cant, and flap angle to overcome any mechanical of human error, and respond to varying wind and sea conditions.

Improved hull shapes for yachts taking advantage of the principles of this invention are disclosed in the three embodiments of FIGS. 12 to 19. In each, there is provided a lower hull which intersects and joins an upper hull along one of the waterline curves of the yacht. For convenience, the upper hull portion and the lower hull portion will hereinafter be referred to as the upper hull and the lower hull respectively. The lower hull sections are semi-circular in section and laterally converge inward toward the bow with a decreasing radius, in section, so as to generally lie on the surface of a right circular conical form. The upper hulls are formed with portions having lateral extent greater than that of the lower hull for defining hydroplaning surfaces when the yacht is heeled.

Two basic features of the adjustable flap 20 are: 1) the aforementioned benefits of increased heel control, and 2) a reduction in the mass of a ballast which is required to generate counter-heeling force. That is, the ballast weight (and thus overall yacht weight) can be reduced since supplemental counter-heeling force is attainable by operating the heel control flap, thereby increasing the apparent weight and providing adequate heeling resistance. Decreased weight is important, as discussed hereinbelow, for achieving a hydroplaning condition of the hull wherein a minimized ratio of vessel weight to sail area is highly desirous. Research has shown that a weight to sail area ratio of approximately 5 to 1 is attainable with a yacht in accordance with the present invention. It is this background that serves as an introduction of the improved hull forms disclosed herein.

Figure 12:
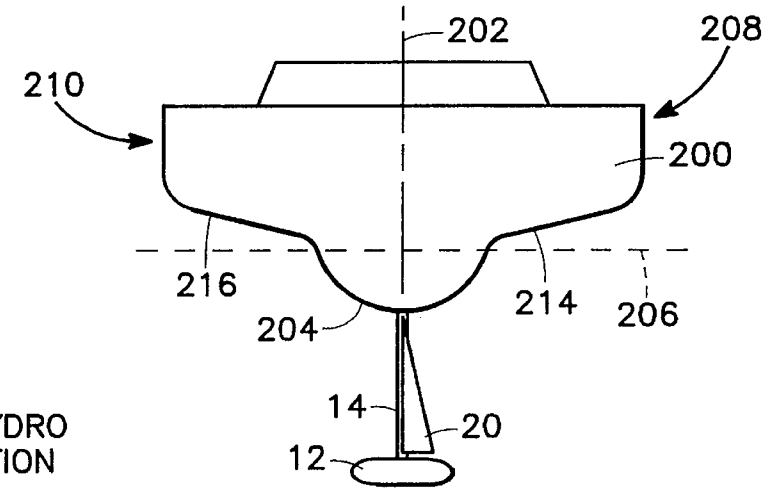
FIG. 12 is perspective model stern-on view of an improved duplex mono-hull form of a yacht constructed in accordance with the present invention, with foils removed for clarity.
Figure 13:
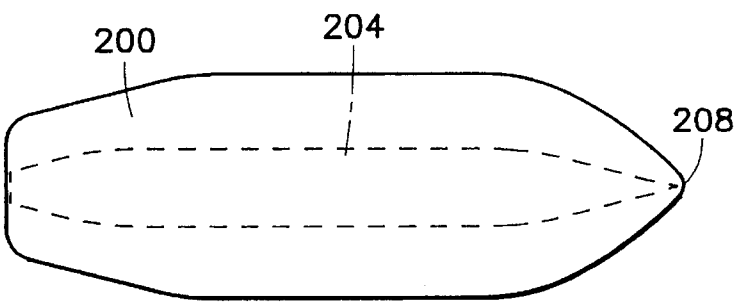
FIG. 13 is an underside view of the model illustrated in FIG. 12, with strut, ballast, and heel control flap removed for clarity.

In FIGS. 12 and 13 the upper hull 200 is generally bulbous in shape, curved and tapered substantially linearly toward the midplane 202 as it merges into and joins the lower hull 204 at waterline 206 near the turn of the bilge at midships section. The upper hull 200 forms topsides 208, 210 for the yacht that are substantially larger in lateral extent than the lower hull 200. The upper hull converges with increasing radius toward the bow 212. The effect is to produce an outwardly flared wing-like transition around the yacht for additional buoyancy when desired for in port operation, and the like, as well as for additional accommodation space. Thus, substantial planar surfaces 214, 216 defined on the upper hull commence contact with the water an angle of heel α to provide enhanced running performance and additional stability for sailing or when moored. In the illustrated embodiment, surfaces 214, 216 are constructed to commence contact with the water when the yacht is at about 15 degrees of heel.

Thus the concept of a bi-modal or duplex hull which has a slender buoyancy center body of semi-circular section and an upper, laterally extended hull for hydroplaning on the bow and stern waves when the yacht is heeled cooperates completely with the heel control flap 20. Specifically, the fine control and reduced weight made possible with the heel control flap 20 of the present invention facilitates the hydroplaning condition and provides the attendant advantages in drag reduction and running speed.

Figure 15:
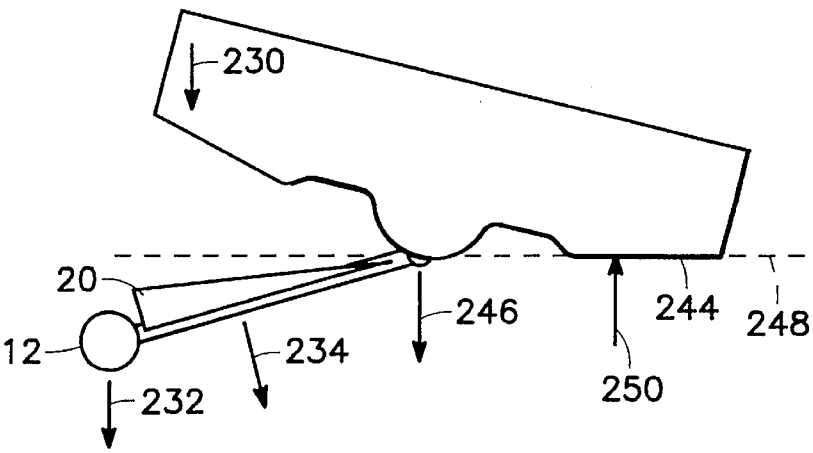
FIG. 15 is a stern-on view of the hull form shown in FIG. 14 at an angle of heel of about 15 degrees.
Figure 14:
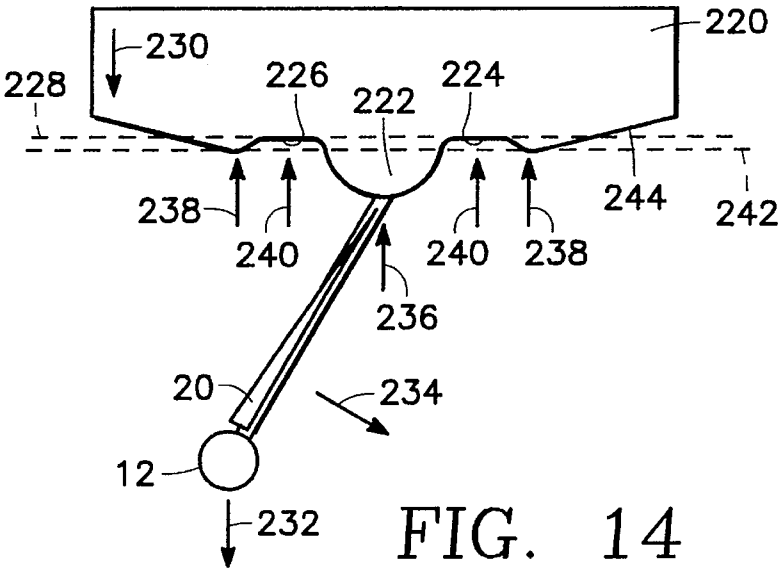
FIG. 14 is perspective model stern-on view of a second improved hull form of a yacht constructed in accordance with the present invention.

Referring now to FIGS. 14 and 15, there is shown a further development of the duplex mono hull sailing yacht in which the upper hull 220 merges with the lower hull 222 to define a pair of longitudinally extending channels 224, 226 spaced symmetrically amidships. At low speeds, such as speeds below about 5 knots, the hull is supported at a waterline 228 wherein crew weight force 230, ballast weight force 232, and a vertical component of heel control flap force 234 is reacted by buoyancy force 236 applied to the lower hull 222 and lift force 238 generated by the hull form. At increased speeds, such as speeds between about 5 and about 10 knots, bow and stern waves traveling along the channels 224, 226 induce an additional lift force 240 for supporting the hull at a lowered waterline 242 for faster sailing.

FIG. 14 shows the yacht illustrated in FIG. 13 operating at a critical speed with the flap 20 controlling heel at the design angle of planing surface 244 on upper hull 220. In the exemplary embodiment, the heel is controlled at about 15 degrees, wherein crew weight force 230, ballast weight force 232, and hull weight force 246 are entirely supported on waterline 248 by hydrodynamic lift force 250 generated on the leeward planing surface 244. The lift force 250 augments the counter-heeling effects produced by the ballast 12 and the heel control flap 20 for enhancing boat stability under extreme weather conditions.

Figure 16:
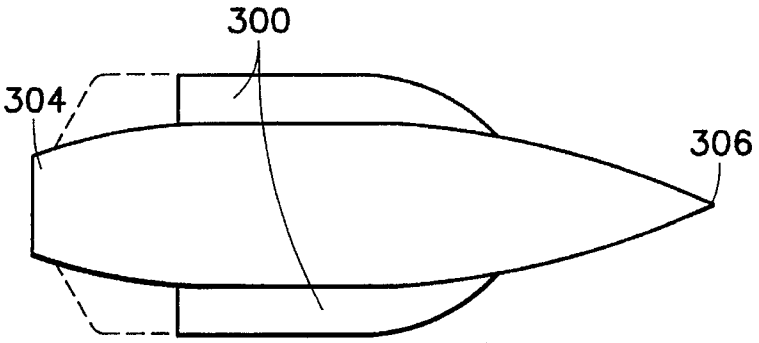
FIG. 16 is plan view of a third improved hull form of a yacht constructed in accordance with the present invention.

FIG. 16 shows the plan view of a yacht similar to that of FIGS. 12 through 15 in which bow wings 300 have been added at substantially only the hull center section. Each bow wing provides concentrated accommodation space outboard of the lower hull 304 so that waves encountered by the bow 306 are effectively dissipated prior to contact with the bow wings and occupants of the accommodation space are not subjected to undue pitching moment and associated discomfort. Further, the outboard compartments define inherent reserve buoyancy in a yacht such that in the event of a failure of the canting ballast system, the yacht will go to heel until the upper hull engages the water surface, at which point a reserve righting moment is provided independent of the heel control flap 20 and the dynamic ballast 12.

Figure 18:
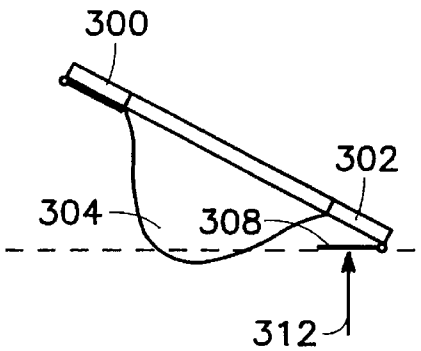
FIG. 18 is a stern-on view of the hull form shown in FIG. 17 with the hinged plan surface on the bow wing contacting the water.
Figure 17:
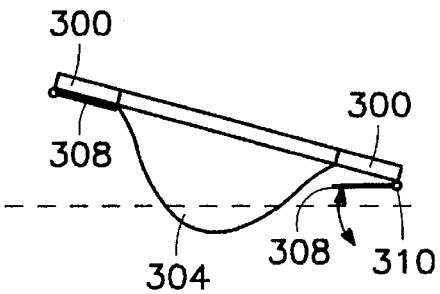
FIG. 17 is a stern-on view of the hull form shown in FIG. 16 at an angle of heel of about 15 degrees.

FIGS. 17 and 18 show the forebody of the yacht in FIG. 16 wherein the wings 300 consist of a strong panel 308 mounted to a hinge 310 aligned fore and aft on an arbitrary waterline of the hull such as the load waterline. The panels 300 preferably take the shape of a flat shell conforming to that of the shape of the wings 300 so that each panel will lie flush with the hull when retracted. Actuators preferably are mounted inside the hull and are provided with actuator arms extending through the hull and connected to the panel at a distance from the hinge, so that extension of the actuator arm opens the panel downwardly away from the hull to lie in a generally horizontal position when the yacht is heeled as shown in phantom lines at 17 and develop hydrodynamic lift force 312.

Figure 20:
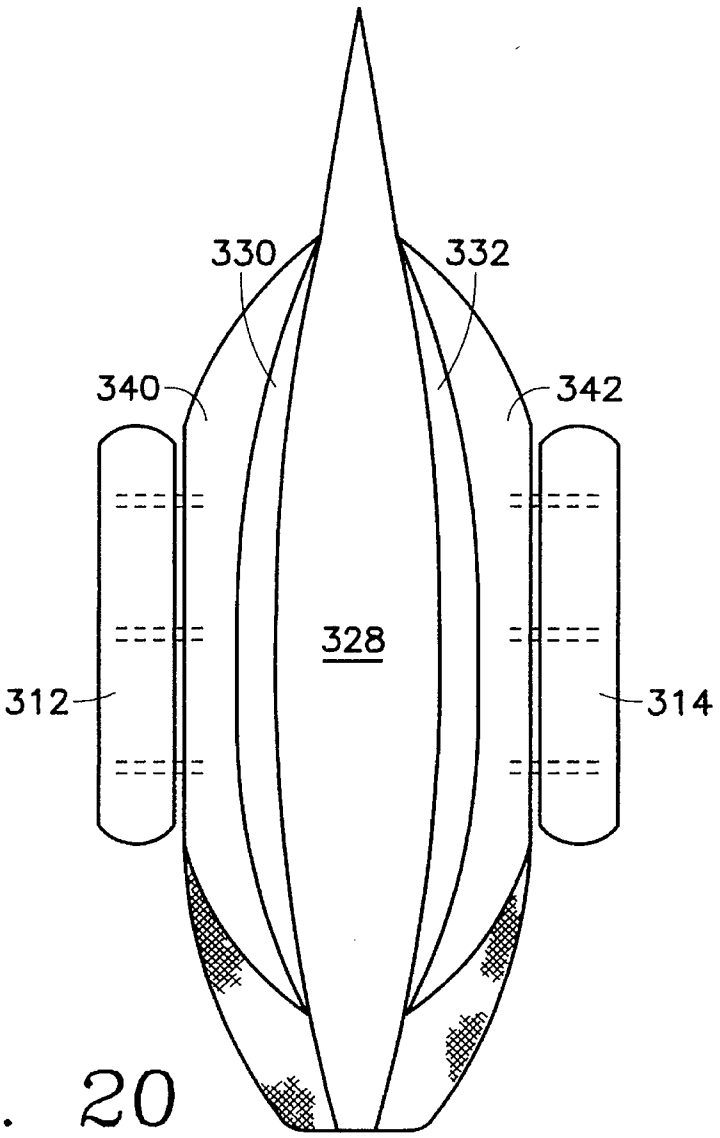
FIG. 20 is a bottom plan view of the yacht hull of FIG. 19.
Figure 19:
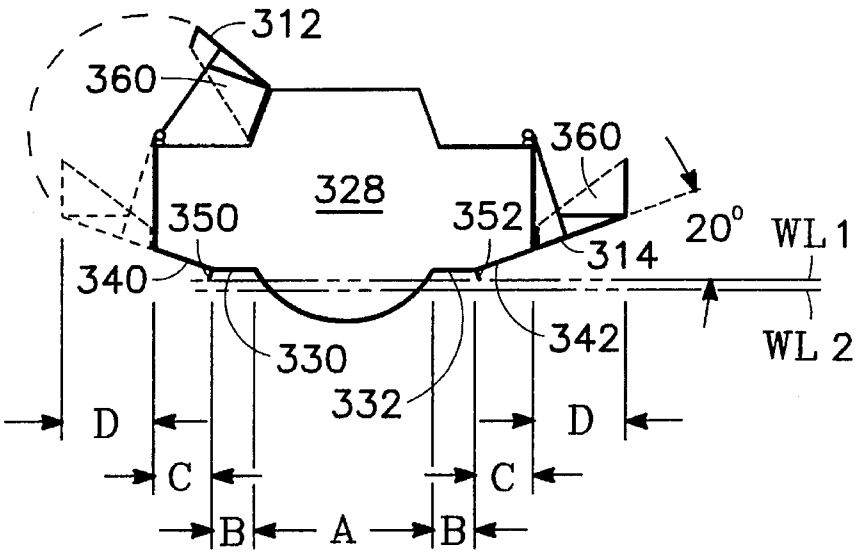
FIG. 19 is a transverse section through a alternate embodiment of hull form for a bimodal sailing yacht hull, constructed in accordance with the present invention.

FIGS. 19 and 20 show an alternate embodiment 311 of the duplex, or bi-modal, hull concept of the present invention with added folding planing wings 312, 314 to provide added anti-heel safety and an enlarged surface for planing with advantages for trailering and/or berthing with reduced beam, and to provide also for reducing weight and cost where hull width extensions are able to provide not only fixed planing surfaces but also provide adequate interior cabin width.

The bi-modal hull is characterized as a mono hull (not a multi-hull) made up of three sections:

(a) a buoyancy section 328 having the form of a long narrow central hull of circular section for providing lift with minimum drag at, say, 0–10° heel;

(b) duplex sections 330, 332 extending outwardly from the buoyancy section for providing a semi-planing flat lateral surface for recapturing some of the energy generated in the form of bow and stern waves; and (c) planing sections 340, 342 for semi-planing or planing (depending on speed) whenever the boat is heeled to, say, 20°.

The duplex sections 330, 332 are lateral extensions from the buoyancy hull section 328 at or just above the waterline with a width of approximately 25% of the waterline beam. As the boat accelerates at 0–10° heel, the bow and stern waves increase and provide "forward" lift on the duplex section. Fins 350, 352 are provided at the outboard edges of each duplex section, respectively, to prevent loss of the lateral force of bow and stern waves to maximize lift. The bow and stern waves move forward with the boat and at the same speed at the moment of generation by hull friction. Thus, both lift energy and also forward thrust are recovered in this design.

The lift of bow and stern waves acting on the buoyancy and duplex sections raises the boat, lowering the waterline as shown in FIG. 19, to WL2, from the normal waterline WL1, to reduce wetted surface and drag.

Figure 21:
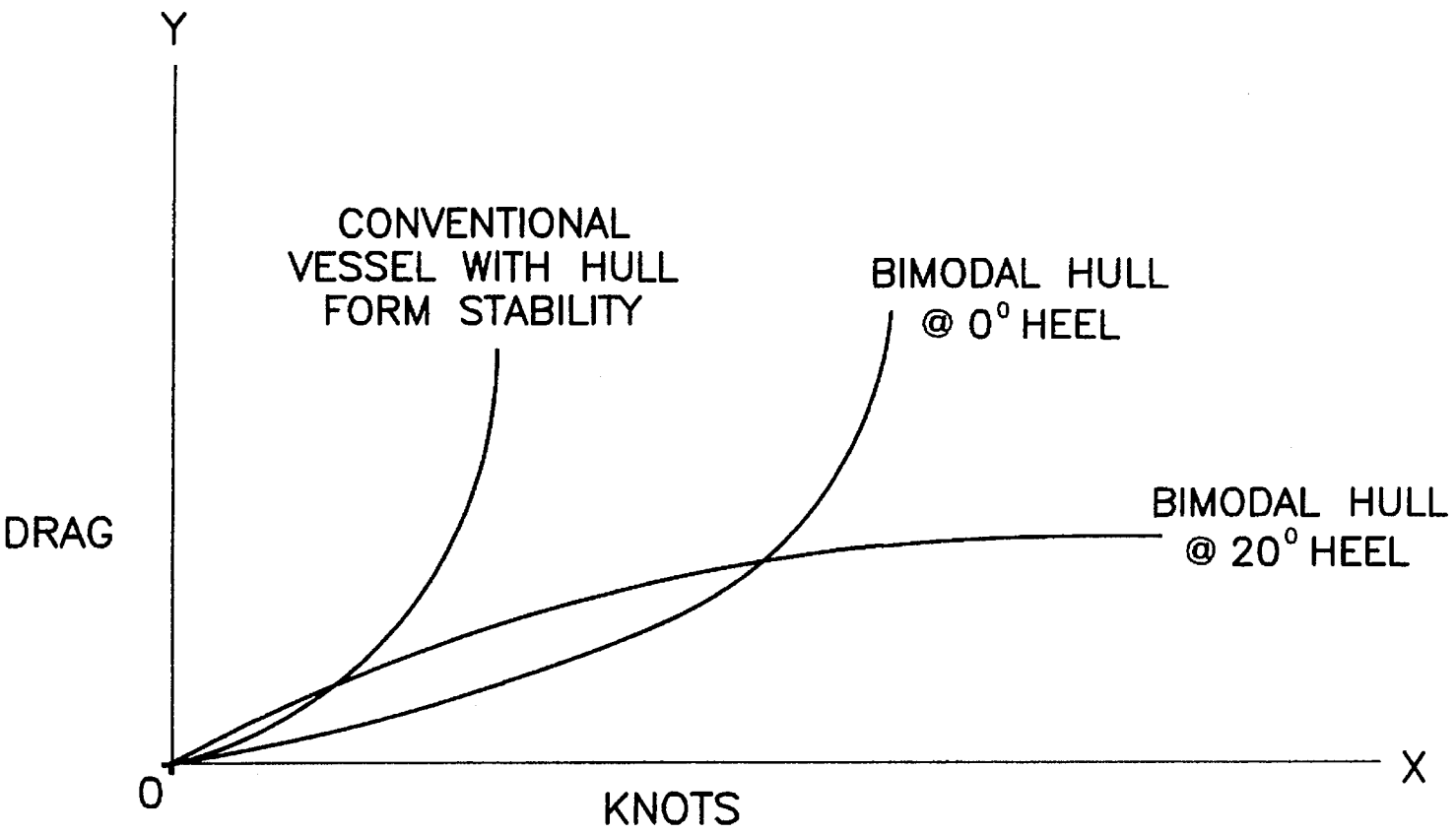
FIG. 21 are graphs depicting the expected performance of the yacht hull of FIGS. 19 and 20 compared to a conventional yacht hull.

The buoyancy and duplex hull sections 330, 340 function together throughout a large range of from about 0° to 10° heel. Although, it would require actual tow tank testing to establish the optimum design and performance quantifications, it is expected that a significant stretching of the hull speed upper limit will result from the use of the slender buoyancy hull and waterline length-to-beam ratio of 7 to 8, as shown in the present application, when compared with approximately 3 for the conventional sailboat (which depends to a great extent on hull form for stability). Thus, the rule of thumb for a conventional sailboat which results in a hull speed limit of 1.34 times the square root of the waterline length is expected to be increased to as high as three (3) times the square of the water line length for the hull of the present invention. FIG. 21 shows graphs of these relationships.

The planing sections 340, 342 built into the hull at a 20° angle, provide three benefits:

(1) Counter heeling force from both hydrodynamic lift and added buoyancy when heeled to 20°±, provides an added safety factor in high winds and/or with malfunctioning of the canting ballast.

(2) Expanded space for cabin comfort, and (3) A planing surface for decreased drag.

FIG. 21 are graphs illustrating a comparison of drag vs. speed for a conventional sailboat with a sailboat constructed in accordance with the present invention.

FIGS. 19 and 20 also provide a sketch of a planing wing extensions 312, 314 hinged on the deck 316 for folding to reduce overall beam for berthing and/or trailering. These also provide increased planing surface at little additional weight cost. Furthermore, it provides an important added safety factor on extreme heeling with hydrodynamic and buoyancy counterheeling - - - the latter from a foam addition 346 on top of the planing surface.

To those skilled in the art to which the present invention pertains, many other improvements will also occur and should be understood to be within the spirit and scope of this invention, which is only to be limited by the following claims.

For example, a more sophisticated heel control device may be envisaged using three mercury tubes, one level, one at 20° to port, and a last at 20° to starboard with a switch to select the one to be activated could provide a simple but effective solution to obtaining a heel control signal.

What is claimed is:

1. A sailing yacht comprising a sailing hull with a longitudinal dimension, a bow and stern, port and starboard sides, and a mast with at least one sail, comprising:

a ballast, an elongated strut having one end connected to said ballast for supporting the same, means for mounting said strut to depend from said hull for supporting said ballast generally below said hull and for providing movement of said strut laterally relative to the hull for generating a gravitational righting force for countering heeling thereof under sail, an adjustable flap, means for mounting said flap to said strut for movement relative thereto about an axis in general alignment with said strut, control means for moving said flap relative to said strut for providing hydrodynamic forces for generating a moment about said longitudinal axis a moment tending to hold said yacht at a desired angle of heel, fore and aft foils mounted to depend from said hull and extending downwardly therefrom for controlling the leeway made by said yacht, means for turning said foils for creating a yawing moment with respect to each other for steering said yacht.

2. The sailing yacht as in claim 1 further including means for sensing the angle of heel of said yacht, means for generating a demand signal representing the desired angle of heel, and means responsive to said demand signal and said sensed angle for moving said flap relative to said strut to counter heeling force encountered by said hull by the demanded amount.

3. The sailing yacht as in claim 2 further in which said sensing means is an inertial sensor responsive to the heeling angle of said hull.

4. A sailing yacht comprising a sailing hull with a bow and stern extending along a centerline at midships, port and starboard sides, and a mast with at least one sail, comprising:

a ballast, means for supporting said ballast generally below said hull and for providing lateral movement of said ballast about a first axis lying fore and aft on said centerline for generating a gravitational righting moment for countering heeling thereof under sail, means defining a control surface on said supporting means, said control surface being movable relative to said ballast about a second axis, means for moving said control surface about said second axis for providing a moment tending to hold said yacht at a desired attitude, fore and aft foils mounted to depend from said hull and extending downwardly therefrom for controlling the leeway made by said yacht, means for turning said foils for creating a yawing moment with respect to each other for steering said yacht.

5. The sailing yacht as in claim 4 further in which said hull comprises a lower hull, and an upper hull having a lateral extent greater than that of said lower hull for planing and for increased stability when heeled, said upper and lower hulls being merged at one of the waterlines of said yacht.

6. The sailing yacht of claim 5 further in which said upper hull is generally bulbous in shape, flaring linearly toward said lower hull as it merges into said waterline.

7. The sailing yacht of claim 4 in which said second axis is substantially perpendicular to said first axis.

8. The sailing yacht of claim 4 further including means for moving said second axis about said first axis.

9. A sailing yacht comprising a sailing hull with a bow and stern extending along a centerline at midships, port and starboard sides, and a mast with at least one sail, comprising:

a ballast, an elongated strut having one end connected to said ballast for supporting the same, said strut defining a hydrodynamically shaped foil having variable camber, means for mounting said strut to depend from said hull for supporting said ballast generally below said hull, means for adjusting the camber of said foil while underway for providing a moment tending to hold said yacht at a desired angle of heel, fore and aft foils mounted to depend from said hull and extending downwardly therefrom for controlling the leeway made by said yacht, means for turning said foils for creating a yawing moment with respect to each other for steering said yacht.

10. The sailing yacht as in claim 9 wherein said strut includes a main body, and wherein means for adjusting the camber of said foil comprises an adjustable flap mounted from the aft portion of said main body.

11. A sailing yacht comprising a sailing hull with a bow and stern extending along a centerline at midships, port and starboard sides, and a mast with at least one sail, comprising:

a ballast, an elongated strut having one end connected to said ballast for supporting the same, means for mounting said strut to depend from said hull for supporting said ballast generally below said hull and for providing movement of said strut about a first axis lying fore and aft on said centerline and shifting said ballast port or starboard from a generally mid position for generating a gravitational righting moment for countering heeling thereof under sail, first drive means for moving said strut about said first axis, an adjustable flap, means for mounting said flap to rotate relative to said strut about a second axis, second drive means for rotating said flap about said second axis for providing a moment tending to hold said yacht at a desired attitude, each of said first and second drive means being operable independently from the operation of the other, fore and aft foils mounted to depend from said hull and extending downwardly therefrom for controlling the leeway made by said yacht, means for turning said foils for creating a yawing moment with respect to each other for steering said yacht.

12. The sailing yacht as in claim 11 in which said means for mounting said strut includes a bearing block mounted in said hull, and a shaft carried by said strut and set into said bearing block in alignment with said second axis so that said strut is swingable port or starboard about said shaft.

13. The sailing yacht as in claim 12 in which said bearing block opens through said hull, and in which said strut extends through said opening, and seal means carried in said bearing block for sealing said shaft and said bearing block against passage of water into said hull.

14. The sailing yacht of claim 12 in which said means for mounting and moving said strut includes a bearing mounted shaft integral with said strut, a control arm mounted on said shaft, and linear actuator means connected between the control arm and the hull for applying force to the control arm and for rotating the strut about the shaft longitudinal axis.

15. In a sailing yacht including a keelless sailing hull having a bow and stern, and a centerline at midships, port and starboard sides, a mast with at least one sail, and a solid ballast, the improvements comprising, in combination:

fore and aft foils mounted to depend from said hull and extending downwardly therefrom for controlling the leeway made by said yacht, means for turning said foils for creating a yawing moment with respect to each other for steering said yacht, an adjustable flap, means for mounting said flap generally below said hull for movement about a first axis, said first axis being movable about a second axis lying fore and aft on said centerline, first control means for rotating said first axis about said second axis, second control means for rotating said flap about said first axis for providing a moment tending to hold said yacht at a desired angle of heel independent of steering control of said yacht.

16. A sailing yacht comprising a sailing hull with a bow and stern extending along a centerline at midships, port and starboard sides, and a mast with at least one sail, comprising:

a ballast, an elongated strut having one end connected to said ballast for supporting the same means including a hollow shaft for mounting said strut to depend from said hull for supporting said ballast generally below said hull for countering heeling thereof under sail and for providing movement of said strut about the longitudinal axis of said shaft, means connected to said strut for shifting said ballast to port or to starboard from a generally mid position while said yacht is underway, an adjustable flap, a hinge interconnected between a leading edge of the flap and a trailing edge of the strut to permit rotation of the flap relative to the strut about a second axis generally orthogonal to said shaft axis, means connected to said flap for rotating the same about said second axis alternately from a generally neutral position to opposed limit positions thereof and for securing said flap at any position therebetween while said yacht is underway, said means for rotating the flap including a linkage having an input member extending through said shaft and an output member, said input and output members each having first and second ends, first means for mechanically coupling the first end of said output member and the second end of said input member, second means for mechanically coupling the second end of said output member and said flap, said first and second means being constructed and arranged so that application of a command input to the first end of said input member causes actuation of said output member and induces rotation of said flap about said second axis for providing a moment tending to hold said yacht at a desired angle of heel, fore and aft foils mounted to depend from said hull and extending downwardly therefrom for controlling the leeway made by said yacht, means for turning said foils for creating a yawing moment with respect to each other for steering said yacht.

17. The sailing yacht as in claim 16 in which the coupling between the first end of the output member and the second end of the input member occurs outboard of the hull, said yacht further including seal means intermediate said input member second end and said hollow shaft for sealing said shaft against the passage of water into said hull.

18. In a keelless sailing yacht including a sailing hull having a bow and a stern extending along a centerline at midships, port and starboard sides, a mast with at least one sail, and a cantable solid ballast suspended from the underside of the hull by a strut for countering heeling thereof under sail by moving said strut and shifting said ballast while said yacht is underway, the improvements comprising:

an adjustable flap, means for connecting said flap to said strut and for providing movement of said flap relative to said strut, control means connected to said flap for rotating the same alternately from a generally neutral position to opposed limit positions thereof and for securing said flap at any position therebetween while said yacht is underway for providing a moment tending to hold said yacht at a desired angle of heel, fore and aft foils mounted to depend from said hull and extending downwardly therefrom for controlling the leeway made by said yacht, means for turning said foils for creating a yawing moment with respect to each other for steering said yacht.

19. A sailing yacht comprising a sailing hull having a bow and a stern extending along a centerline at midships, and port and starboard sides, said hull having lower and upper portions, said hull portions being merged at a waterline of said yacht, said lower hull portion having sections that lie on a generally circular shape and which laterally converge toward the bow, and said upper hull portion having a lateral extent greater than that of said lower hull portion and including means for defining at least one substantially planar surface on the underside of said upper hull portion for contacting the surface of water over which said yacht is moving and assisting said hull toward planing when said yacht is at a desired angle of heel, fore and aft foils mounted to depend from said hull and extending downwardly therefrom for controlling the leeway made by said yacht, means for turning said foils for creating a yawing moment with respect to each other for steering said yacht, a ballast, an elongated strut having one end connected to said ballast for supporting the same, means for mounting said strut to depend from said hull for supporting said ballast generally below said hull and for providing movement of said ballast about a first axis lying fore and aft on said centerline for countering heeling thereof under sail, means defining a control surface on said strut, said control surface being movable relative to said ballast about a second axis, and means for moving said control surface about said second axis for providing a moment tending to hold said yacht at a desired attitude.

20. A sailing yacht as in claim 19 where said upper hull includes:

a panel, a panel hinge mounted between the underside of the upper hull and said panel for supporting the same, said panel taking the shape of a flat shell conforming to that of the shape of the hull so that each panel will lie flush with the hull when retracted, and actuator means mounted inside the hull for selectively opening the panel downwardly away from the hull to lie in a generally horizontal position when the yacht is heeled.

21. A sailing yacht as in claim 19 in which said planar surface is at an angle of approximately 15 degrees relative to the horizontal when the yacht is at zero heel.

22. In a keelless sailing yacht, a sailing hull having a bow and a stern extending along a centerline at midships, and port and starboard sides, and a mast with at least one sail, said hull having lower and upper portions, said lower hull portion having sections that lie on a generally circular shape and which laterally converge toward the bow, and said upper hull portion having a lateral extent greater that of said lower hull portion to jointly define laterally spaced topsides outboard of said lower hull portion and for increased stability when heeled, said upper hull portion having a pair of laterally opposed substantially planar surfaces on the underside thereof for contacting the surface of water over which said yacht is moving and assisting said hull toward planing when said yacht is at a desired angle of heel, said hull sections being merged at a waterline of said yacht to define a pair of downwardly opening channels which extend longitudinally of said hull intermediate said lower hull portion and said planing surfaces for directing waves encountered by the bow of said hull to apply a lift force for lowering the waterline and reducing drag on the hull, fore and aft foils mounted to depend from said hull and extending downwardly therefrom for controlling the leeway made by said yacht, means for turning said foils for creating a yawing moment with respect to each other for steering said yacht.

23. A sailing yacht as in claim 22 in which said upper hull portions are substantially confined to the approximate midsection of the hull so that waves encountered by the bow are effectively dissipated before reaching the upper hull to reduce pitching moment experienced at said topsides.

24. A sailing yacht comprising a sailing hull having a bow and a stern extending along a centerline at midships, and having port and starboard sides, said hull having lower and upper portions, said hull portions being merged at a waterline of said yacht, said lower hull portion having sections that lie on a generally circular shape and which laterally converge toward the bow, and said upper hull portion having a lateral extent greater than that of said lower hull portion, means cooperating with said upper hull portion to define at least one substantially planar surface on the underside of said hull for contacting the surface of water over which said yacht is moving and assisting said hull toward planing when said yacht is at a desired angle of heel, a solid ballast, an elongated strut having one end connected to said ballast for supporting the same, means for mounting said strut to depend from said hull for supporting said ballast generally below said hull for countering heeling thereof under sail, means defining a control surface on said strut and rotatable relative thereto, means for rotating said control surface for providing a moment tending to hold said planing surface in contact with the water surface, fore and aft foils mounted to depend from said hull and extending downwardly therefrom for controlling the leeway made by said yacht, means for turning said foils for creating a yawing moment with respect to each other for steering said yacht.

25. A keelless sailboat comprising a sailing hull having a bow and a stern extending along a centerline at midships, and having port and starboard sides, said hull having lower and upper portions, said hull portions being merged at a waterline of said yacht, said lower hull portion having sections that lie on a generally circular shape and which laterally converge toward the bow, said upper hull portion having a lateral extent greater than that of said lower hull portion to define a substantially planar surface on the underside of said hull for contacting the surface of water over which said yacht is moving and assisting said hull toward planing when said yacht is at a desired angle of heel, said hull, when moving over a body of water, causing bow and stern waves to develop fore and aft, a ballast, an elongated strut having one end connected to said ballast for supporting the same, means for mounting said strut to depend from said hull for supporting said ballast generally below said hull for countering heeling thereof under sail and for providing movement of said ballast about a first axis lying fore and aft on said centerline, an adjustable flap, means for mounting said flap on said strut for rotation about a second axis and relative thereto, control means for rotating said flap about said second axis for providing a moment tending to hold said hull at a desired angle of heel, fore and aft foils mounted to depend from said hull, extending downwardly and generally into said bow and stern waves for controlling the leeway made by said yacht, means for turning said foils for creating a yawing moment with respect to each other for steering said yacht.

26. A sailing yacht comprising a sailing hull with a bow and stern extending along a centerline at midships, port and starboard sides, and a mast with at least one sail, comprising:

a ballast, an elongated strut having one end connected to said ballast for supporting the same, means for mounting said strut to depend from said hull for supporting said ballast generally below said hull and for providing movement of said strut about a first axis lying fore and aft on said centerline and shifting said ballast port or starboard from a generally mid position for countering heeling thereof under sail, first drive means for moving said strut about said first axis, an adjustable flap, means for mounting said flap to rotate relative to said strut about a second axis, second drive means for rotating said flap about said second axis for providing a moment tending to hold said yacht at a desired attitude, each of said first and second drive means being operable independently from the operation of the other, said second drive means including a linkage having an input member mounted in the hull and an output member, said input and output members each having first and second ends, means for mechanically coupling said output member and said input member and for mechanically coupling said output member and said flap, said coupling means being constructed and arranged so that application of a command input to said input member causes actuation of said output member and induces rotation of said flap about said second axis for providing a moment tending to hold said yacht at a desired angle of heel.

27. A sailing yacht comprising a sailing hull having a bow and a stern extending along a centerline at midships, and having port and starboard sides, said hull having lower and upper portions, said hull portions being merged at a waterline of said yacht, said lower hull portion having sections that lie on a generally circular shape and which laterally converge toward the bow, and said upper hull portion having a lateral extent greater than that of said lower hull portion, means cooperating with said upper hull portion to define at least one substantially planar surface on the underside of said hull for contacting the surface of water over which said yacht is moving and assisting said hull toward planing when said yacht is at a desired angle of heel, a solid ballast, an elongated strut having one end connected to said ballast for supporting the same, means for mounting said strut to depend from said hull for supporting said ballast generally below said hull for countering heeling thereof under sail, means defining a control surface on said strut and rotatable relative thereto, means for rotating said control surface for providing a moment tending to hold said planing surface in contact with the water surface, and a selectively openable portal in the planing surface of said upper hull portion for facilitating egress when the yacht is in a broached condition, said portal not normally being in contact with the water when said yacht is at zero heel.

* * * * *